US005833391A

United States Patent [19]

Daigle

[11] Patent Number: 5,833,391

[45] Date of Patent: Nov. 10, 1998

[54] CHEMICAL PUMP CONTAINMENT AND METHOD OF CONTAINING LIQUID SPILLAGE

[76] Inventor: Todd Daigle, 1650 St. Claire, Church Point, La. 70525

[21] Appl. No.: 855,491

[22] Filed: May 13, 1997

[51] Int. Cl.[6] ..... E02B 13/00; E03B 11/00

[52] U.S. Cl. ..... 405/52; 405/128; 137/312; 141/86; 588/259

[58] Field of Search ..... 405/52, 128; 137/312, 137/363; 141/86; 588/259, 260

[56] References Cited

U.S. PATENT DOCUMENTS

| | | | |
|---|---|---|---|
| 1,964,034 | 6/1934 | Cook | 137/363 |
| 3,461,803 | 8/1969 | Stothoff, III et al. | 137/363 |
| 4,842,163 | 6/1989 | Bravo | 137/312 X |
| 4,842,443 | 6/1989 | Argandona | 137/312 X |
| 4,968,179 | 11/1990 | Frahm | 405/52 X |
| 5,005,615 | 4/1991 | McGarvey et al. | 137/312 X |
| 5,098,221 | 3/1992 | Osborne | 405/128 X |
| 5,184,751 | 2/1993 | Middleton | 141/86 X |
| 5,327,948 | 7/1994 | Blackmore | 137/312 X |
| 5,501,143 | 3/1996 | Palazzo | 137/312 X |

*Primary Examiner*—David J. Bagnell
*Assistant Examiner*—Jong-Suk Lee
*Attorney, Agent, or Firm*—Robert N. Montgomery

[57] ABSTRACT

A chemical pump containment for enclosing chemical injection pumps mounted on portable chemical tanks used at remote injection sites for collecting leakage generally associated with such pumps and returning such leakage to the tank without contamination. The invention including a lower housing having an adapter for securing the containment to the tank and containing one or more pumps suspended therein. A water tight upper portion is provided and attached to the lower portion by a single fastener for fast removal and service. Leakage from the pumps or connection thereto passes directly though an opening in the adapter and is returned to the tank. The entire containment assembly including its tank adapter may be easily removed when filling the tank with chemicals.

11 Claims, 4 Drawing Sheets

CHEMICAL PUMP CONTAINMENT AND METHOD OF CONTAINING LIQUID SPILLAGE

BACKGROUND OF THE INVENTION

1. Field of the Invention

The present invention relates to containments designed as catch basins to contain spillage of liquid materials which may leak from storage containers into the environment and more particular to chemical pump containments utilized with such storage containers.

2. General Background

Catch basin type containments of various types are used where ever liquid vessels are found to capture any leakage which may occur as a result of minor vessel leakage or spills resulting during filling or removing such liquid from the vessel. Such containments have very limited capacity and must be pumped out or otherwise drained periodically. In some cases, where the storage containers are left at remote unmanned sites, such containments have a tendency to overflow as a result of neglect or rain water accumulation. Thereby contaminating the environment requiring expensive cleanup.

Leakage and spillage of fluids, such as inhibitors and other such corrosion control chemicals used in the oil and gas industry is commonplace and in most instances, if used at all, rely on open catch basins to prevent environmental contamination.

In cases where lift pumps are attached to the top of the chemical container it is often required that such pumps be primed thus producing a considerable amount of the chemical to be deposited in the catch basin if one exist. The spillage must then be pumped out and returned to the tank or otherwise disposed of in some manner. The spillage may be corrosive or toxic and may require special handling resulting in lost time and added expense.

SUMMARY OF THE INVENTION

It is therefore an object of the present invention to provide a removable containment, for totally enclosing chemical pumps and which allows any spillage to drain back into the storage tank thus reducing contamination of the chemical and preventing leakage from contaminating the environment.

Another object of the invention is to provide an enclosed containment for drum pumps and the like which are transferred from drum to drum frequently.

Yet another object of the invention is to prevent rain water from overflowing spill catch basins around liquid pumps.

Additional objects and advantages of the invention will be set forth in part in the description which follows and in part will become evident from the description or in the practice of the invention.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
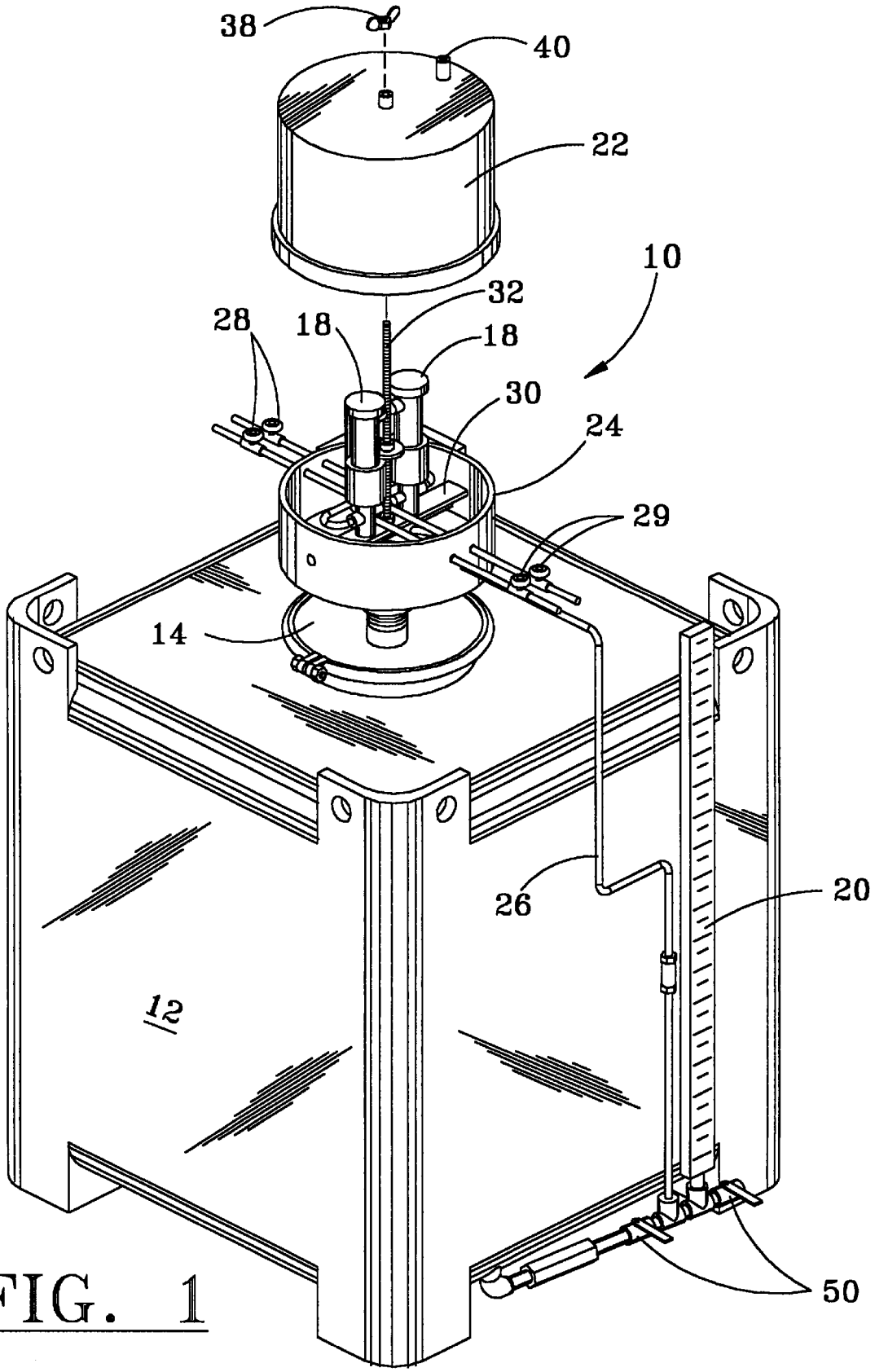
FIG. 1 is an isometric view of the containment mounted to a vessel.
Figure 2:
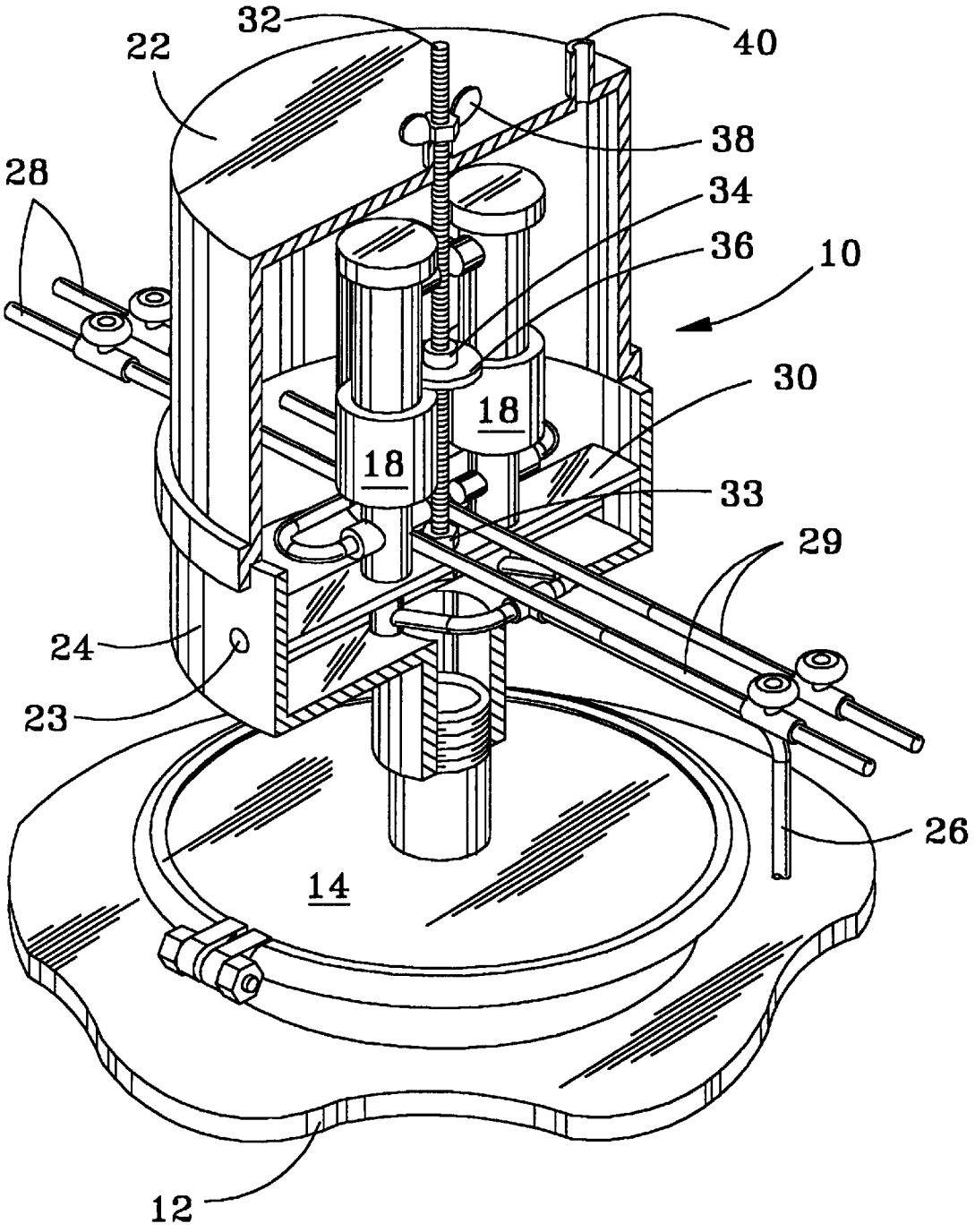
FIG. 2 is cross section view of the containment housing illustrating mounting arrangement.

As illustrated in FIG. 1 the chemical injection pump containment or enclosure 10 is coupled to an existing Department of Transportation type 57 portable chemical reservoir 12 by an adapter fitting 14 more easily seen in FIG. 2 which utilizes the Gerard cover plate or replaces other removable vessel inspection covers normally found on such chemical storage vessels used in the oil and gas industry. Such chemical vessels 12 are generally fitted with one or more pumps, for withdrawing chemicals in the vessel 12 and injecting them into a pipeline or well head at a metered, predetermined, constant rate. The containment 10 is capable of housing any number of pumps of any capacity without changing the over all design or mounting configuration. As seen in FIG. 1 the containment 10 includes an upper or cover portion 22 and a lower portions 24. The lower or collecting portion 24 is a catch basin for any fluids leaking from the pumps 18 or connecting lines such as suction line 26, discharge line 28 and compressed gas lines 29, and funnels any such leakage back into the vessel interior through the filing port adapter 14. The adapter including a threaded tube and plate as seen in FIG. 2. The upper portion 22 serves to cap or cover the pumps 18 and the lower portion 24 thus making the containment rain tight. Ports are provided for fluid lines entering and leaving the containment's lower portion and may also be sealed to prevent leakage and outside environmental contamination of any chemicals returned to the interior of the vessel. A mounting bar or platform 30 is attached to the interior of the lower portion for locating the pump units 18. A threaded stem 32 held in position by a jam nut 33, the stem extending upwards from the mounting bar or platform 30 provides a method of clamping the pumps 18 in position with the use of a nut 34 and washer 36 arrangement. The stem 32 extends through the upper portion of the containment 22 where a wing nut 38 is used to secure the upper portion 22 to the lower portion 24. A vent tube 40 is provided to prevent a vacuum from being drawn on the vessel as a result of pump suction. Suction and discharge lines 26,28 are connected to the pumps 18 and exit the lower portion 24 of the containment. These lines are further connected to the vessel 12 in a communicative manner with the liquid therein, and to auxiliary systems respectively where such chemicals are required. i.e. pipe lines, wells etc.

The pumps 18 are electric or gas powered and are used singly or in tandem or one may be use as back-up for the other. Electrical or gas power systems provide power for the pumps 18 and is supplied through a special port 23 in the lower portion 24 of the containment 10 as seen in FIG. 2 or may utilize the openings provided for the gas inlet lines 29. The Department of transportation approved portable chemical vessels 12, which vary in size and capacity, may be fitted with a sight glass 20 which indicates the liquid level of the vessel's contents. A Fluid suction line 26 leading to the pump or pumps are generally connected externally to the bottom of the chemical tank and run up along the exterior wall, thereby utilizing gravity feed to assist in pump suction from pumps 18 located on top of the tank and to the sight glass 20. Cutoff valves 50 are provided in the suction line for interchangability and replacement of parts etc.

Figure 3:
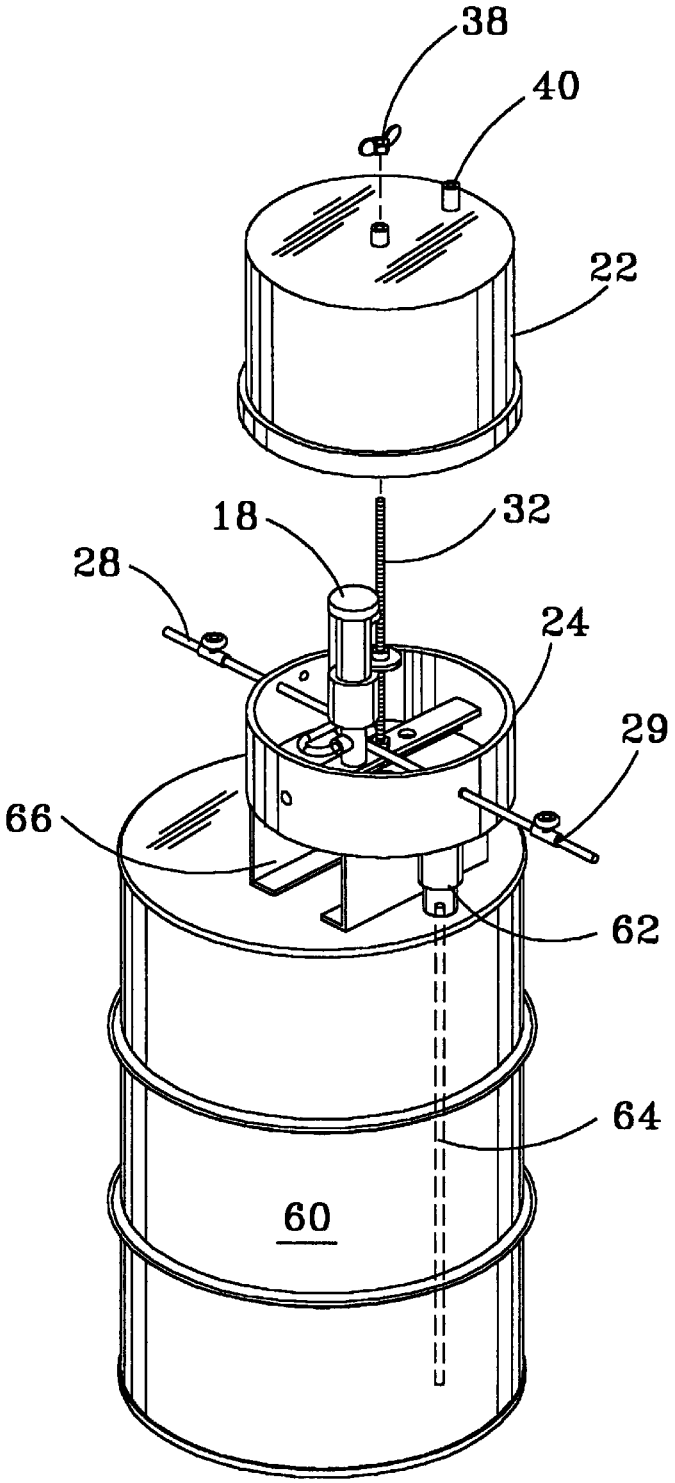
FIG. 3 is an illustration of the containment mounted to a drum.

In most cases the chemical injection pumps 18 are used with special DOT tanks 12. However, in some cases or emergency situations where the special DOT tanks 12 are not available or it becomes impractical to provide a special tank for a small amount of chemical to be injected. It may be more efficient to pump directly from a chemical drum or barrel 60 as shown in FIG. 3. In which case the containment 10 is connected to a coupling 62 fitted to the drum's bung fitting. A pump suction tube 64 extending into the drum interior is also provided. The pump containment 10 is further supported by a support legs 66.

Figure 4:
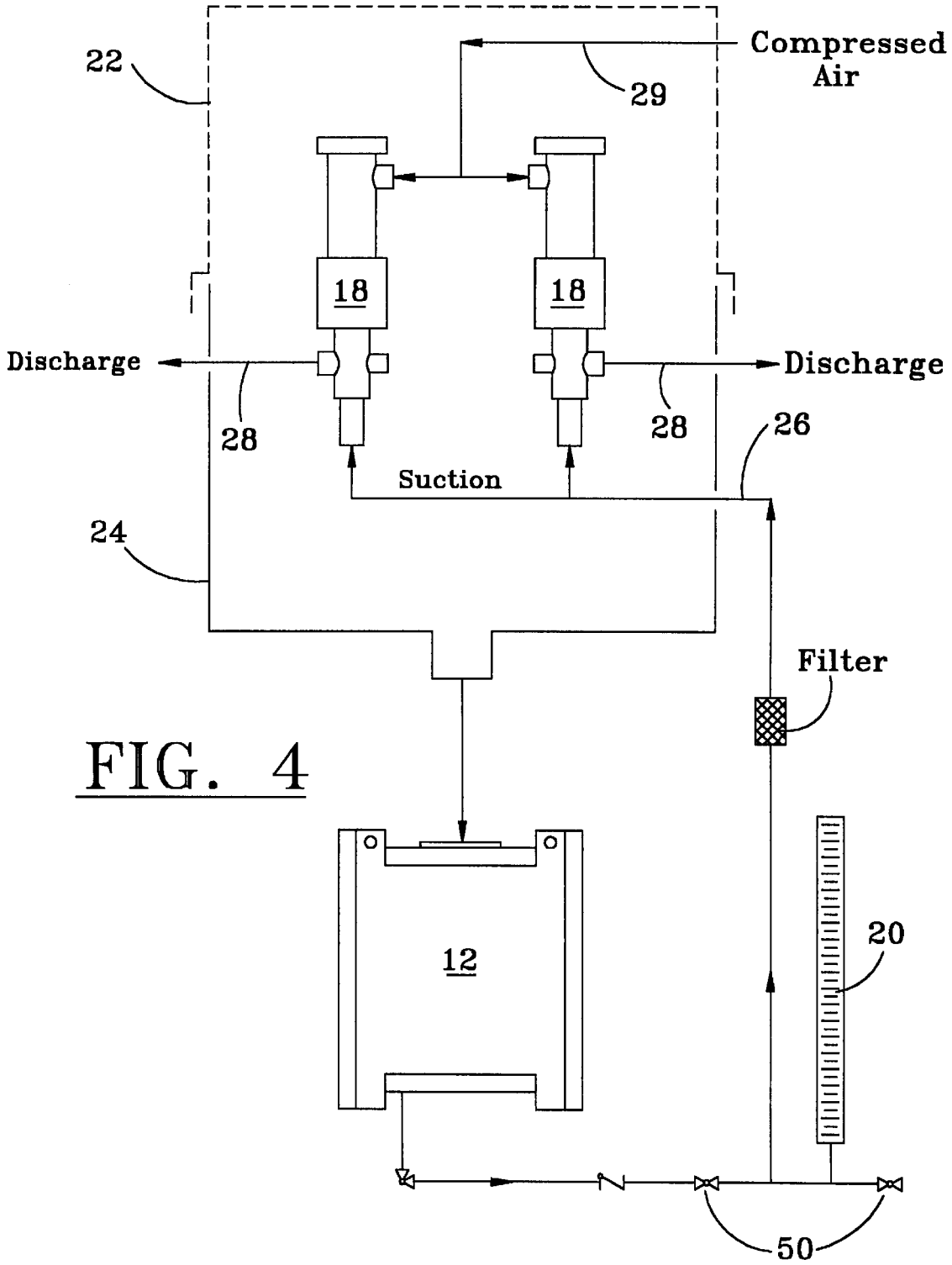
FIG. 4 is piping diagram of the pumping system

A general arrangement of the piping for connecting the chemical tank 12 and the pumps 18 located in a containment 10 is shown in FIG. 4.

Because many varying and different embodiments may be made within the scope of the inventive concept herein taught, and because many modification may be made in the embodiments herein detailed in accordance with the descriptive requirement of the law, it is to be understood that the details herein are to be interpreted as illustrative and not in any limiting sense.

What is claimed is:

1. A chemical injection pump containment comprising:

a) a portable chemical reservoir;

b) an enclosure having opposing upper and lower cup portions said upper portion having means for sealably receiving said lower cup portion and being detachable from said lower cup portion;

c) an adapter means attached to said lower cup portion for attaching and draining said enclosure to said portable chemical reservoir, said adapter means comprising a tubular portion connectable to said enclosure and a plate portion connectable to a filling port on said reservoir said adapter having an unrestricted through passage communicative between interior of said lower cup portion and interior of said chemical reservoir;

d) a means located inside said lower cup portion for mounting at least one said chemical injection pump and for retaining said upper cup portion; and e) a side wall porting means located in said lower cup portion for externally, fluidicly connecting suction, pressure and power supply lines to at least one chemical injection pump located within said lower cup portion to said portable chemical reservoir and to auxiliary systems.

2. The pump containment according to claim 1 wherein said upper cup portion includes a collar for telescopically receiving said lower cup portion said upper portion being removably attached to said lower portion by a single fastener.

3. The pump containment according to claim 1 wherein said means for mounting at least one said chemical injection pump and for retaining said upper portion includes a threaded stem, a washer and a plurality of nuts threadably engaging said stem.

4. The pump containment according to claim 1 wherein said means for mounting said chemical injection pump is a bar attached to interior side walls of said lower portion adapted to receive a portion of said chemical injection pump.

5. The pump containment according to claim 1 wherein said upper cup portion is vented to atmosphere.

6. A chemical injection pump containment comprising:

a) a chemical injection pump enclosure having upper and lower portions, said upper portion being, removable from said lower portion;

b) an adapter means attached to said lower portion for connecting to a portable chemical drum, said adapter means having an unrestricted through passage communicative between interior of said lower portion and said chemical drum;

c) a means located inside said lower portion of said containment for mounting at least one chemical injection pump and for retaining said upper portion said means comprising;

i) a mounting bar adapted to receive a portion of at least one chemical pump suspendedly attached to said inside of said lower portion;

ii) a threaded rod extending upwardly, attached to said bar, iii) a first nut in threadable engagement with said threaded rod and a washer slidable thereon; and iv) a second nut in threadable engagement with said threaded rod; and d) a plurality of tube openings located peripherally in said lower portion;

e) a means for fluidicly connecting said chemical injection pump to contents of said drum and to auxiliary systems; and f) a means for driving said chemical injection pump.

7. The chemical pump containment according to claim 6 wherein said adapter means is connected to the bung fitting of a chemical drum.

8. A method of containing chemical fluid spillage from chemical injection pumps mounted on portable chemical reservoirs comprising:

a) enclosing at least one chemical injection pump with an enclosure, comprising a removable upper cover portion and a lower collecting portion, said lower collecting portion comprising a mounting means therein comprising a bar, a threaded rod, a first nut in threadable engagement with said threaded rod and a washer slidable thereon and a second nut threadably engaged with said threaded rod for mounting said chemical injection pump; an adapting means comprising a tubular portion having an unrestricted longitudinally through opening therein communicative with interior of said lower collecting portion, and ports for admitting power supply, suction and discharge lines;

b) attaching said enclosure to said reservoir and to said adapting means in a manner whereby said opening in said adapting means is fluidicly communicative with interior of said reservoir thereby allowing any leakage from said chemical injection pump to flow into said reservoir through said adapter means;

c) attaching said suction line to said pump and to said reservoir whereby said suction line is communicative with liquids contained by said reservoir;

d) attaching said discharge lines to said pump and to at least one auxiliary system; and e) attaching a power supply to said pump.

9. The method of containing chemical fluid spillage according to claim 8 further including the step of making said enclosure rain tight.

10. The method of containing chemical fluid spillage according to claim 9 including the step of collecting any leakage from said pump and returning said leakage back to said reservoir longitudinally through said adapter means without contamination.

11. The method of containing chemical fluid spillage according to claim 8 including the step of connecting said enclosure to a drum.

* * * * *